US006028260A

United States Patent [19]

LaLonde

[11] Patent Number: 6,028,260

[45] Date of Patent: Feb. 22, 2000

[54] DRUMSTICK INCORPORATING ADJUSTABLE CENTER OF GRAVITY FOR OPTIMUM BALANCE

[76] Inventor: Anthony F. LaLonde, P. O. Box H, San Jose, Calif. 95151

[21] Appl. No.: 09/006,634

[22] Filed: Jan. 13, 1998

[51] Int. Cl.[7] ..... G10D 13/02

[52] U.S. Cl. ..... 84/422.4

[58] Field of Search ..... 84/422.4

[56] References Cited

U.S. PATENT DOCUMENTS 4,226,163 10/1980 Welcomer ..... 84/422
5,218,152 6/1993 Campbell et al. ..... 84/422.4

*Primary Examiner*—William M. Shoop, Jr.
*Assistant Examiner*—Kim Lockett
*Attorney, Agent, or Firm*—John J. Leavitt

[57] ABSTRACT

Presented is an elongated tubular drumstick incorporating an adjustable weight system mounted within the hollow interior of the drumstick and incorporating an elongated threaded spindle that extends nearly the entire length of the drumstick. Adjustably mounted on the threaded spindle are one or more weights. The weight or weights are locked in position between a pair of nuts threaded onto the spindle. A damper member is provided mounted on the distal end of the spindle at the tip-end of the hollow drumstick, and a plurality of annular ring absorbers or silencers are spaced along the length of the threaded spindle to retain the threaded spindle axially aligned within the hollow drumstick. A retainer plug and cushion member is mounted on the proximal end of the threaded spindle and is press-fitted into the open butt end of the drumstick to removably retain the adjustable weight assembly or system within the drumstick.

18 Claims, 2 Drawing Sheets

DRUMSTICK INCORPORATING ADJUSTABLE CENTER OF GRAVITY FOR OPTIMUM BALANCE

BACKGROUND OF THE INVENTION

1. Field of the Invention

This invention relates to a drumstick of the type used by drummers, and more particularly to a drummer's drumstick that incorporates an adjustable weight system to enable customization of the balance of a drumstick to suit the needs of the drummer.

2. Description of the Prior Art

A preliminary patentability and novelty search has revealed the existence of the following patents:

| | | |
|---|---|---|
| 5,044,250 | 5,218,152 | DE 3,902,429 A1 (German) |

Referring to the patents listed above, U.S. Pat. No. 5,044,250 discloses merely a cylindrical tubular "stick" open at both ends and containing a quantity of pellets which function as "noise makers" within the tubular "stick". Clearly, there is no disclosure in this patent that anticipates the instant invention, nor does this patent reasonably "teach" the concept of a variable center of gravity as taught by the instant invention.

U.S. Pat. No. 3,218,152 teaches the concept and a specifically different structure for a "balanced" drumstick that is primarily used for juggling in addition to drumming. The method taught by this patent to secure the balance point (BP) is to cut off some of the length of the drumstick from the butt or heavy end of the shaft, and then drill an appropriate bore into the heavy end of the shaft to shift the BP to place it within the range of from 58% to 62% along the shaft from the butt end of the shaft. Clearly, this patent teaches a structure that is significantly different than the structure of the instant invention. Additionally, the structure of this prior art patent, once accomplished, is not modifiable to change the position of the BP. In the structure of the instant invention, it will be apparent that not only may the weight system be modified to change within a given drumstick the center of gravity or "balance point", but the weight system may quickly and easily be removed from one drumstick and transferred to another and different type of drumstick, again to suit the needs of the drummer.

German Patent DE 3902429 A1 appears to provide a cartridge that may be slipped into the butt end of a drumstick. Within the cartridge there is a short center rod having threads along its length along which a weight may be variably positioned. The center rod is threadably engaged at its inner end to the end wall of the cartridge. At its outer end, the threaded rod is provided with a slotted head to enable rotation of the rod to threadably engage the inner end of the rod with the inner end wall of the cartridge. While this structure may provide a limited control over the placement of the balance point, it is clear that once installed, it cannot be removed and transferred to another drumstick, nor is there sufficient similarity between this patented structure and the instant invention to reasonably "teach" the invention disclosed and claimed herein.

Drumsticks have historically been fabricated from wood. However, through the passage of time, it has become difficult to secure wood of the type from which drumsticks are fabricated. Additionally, since each drumstick fabricated from wood is a separate project involving the skill of the woodworker, it has been found that it is very difficult to "match" two wood drumsticks as to balance and weight. One of the reasons for this is that wood varies in its density, even when taken from a single source. As technology has improved, drumsticks fabricated from various synthetic resinous and synthetic-natural composite materials have begun to compete with solid wood drumsticks. It has been found that because synthetic resinous drumsticks can be infection molded, it is much easier to "match" a pair of drumsticks in terms of balance and weight. The ideal is to "match" a pair of drumsticks so that the balance point is exactly in the same position along the length of the drumstick, and that the two drumsticks of a pair be exactly the same weight, the same length and the same configuration from the butt end of the drumstick to its tip end.

Accordingly, one of the important objects of the present invention is the provision of a drumstick fabricated from a synthetic resinous material to exact parameters that may be accurateley replicated in additional drumsticks so as to facilitate "matching" two drumsticks to provide a pair of "matched" drumsticks.

Another object of the invention is the provision of an adjustabie weight system for a drumstick that may be incorporated into a hollow or tube-like drumstick molded from synthetic resinous material to enable customization of the weight and balance of a drumstick to suit the needs of the drummer.

A still further object of the invention is to provide an adjustable weight system for drumsticks that is fabricated from man-made materials to exact parameters so that a selected adjustable weight system may be accurately replicated to provide a "matched" pair of adjustable weight systems for a given pair of drumstick.

Yet another object of the invention is the provision of a drumstick equipped with an adjustable weight system that can be readily removed from one drumstick and inserted into another drumstick while maintaining the same weight adjustment.

A still further object of the invention is the provision of an adjustable weight system for a drumstick that can be readily adjusted to shift the balance point of the drumstick to the location desired by the drumer, all without the need to use tools of any kind.

Another important object of the invention is the provision of a combination of a synthetic resinous material drumstick and an adjustable weight system that complement each other so as to eliminate extraneous sounds emanating from the drumstick per se as distinguished from the drum head struck by the drumstick.

The invention possesses other objects and features of advantage, some of which, with the foregoing will be apparent from the following description and the drawings. It is to be understood however that the invention is not limited to the embodiment illustrated and described since it may be embodied in various forms within the scope of the appended claims.

SUMMARY OF THE INVENTION

In terms of broad inclusion, the drumstick of the invention incorporating an adjustable weight system comprises an elongated hollow tube of specific length that is open at its butt end and which adjacent its tip end tapers to a bulbous tip end of selected design. The drumstick so formed is symmetrical about a longitudinal axis and is provided at its distal tip end with a small bore that communicates with the larger hollow interior of the drumstick. Mounted within the hollow interior of the drumstick is an elongated threaded spindle that extends nearly the entire length of the drumstick. Adjustably mounted on the threaded spindle, at a selected location that suits the drummer who is to use the drumstick, are one or more weights each of which weighs exactly the same amount as the other weight or weights. The weight or weights are locked in position between a pair lock members mounted on the spindle. A damper member is provided in the tip-end of the hollow drumstick, and a plurality of annular silencers are spaced along the length of the threaded spindle to retain the threaded spindle axially aligned within the hollow drumstick. A retainer plug mounted on the proximal end of the threaded spindle is press-fitted into the open butt end of the drumstick to retain the adjustable weight assembly or system within the drumstick.

DESCRIPTION OF THE PREFERRED EMBODIMENT

Figure 1:
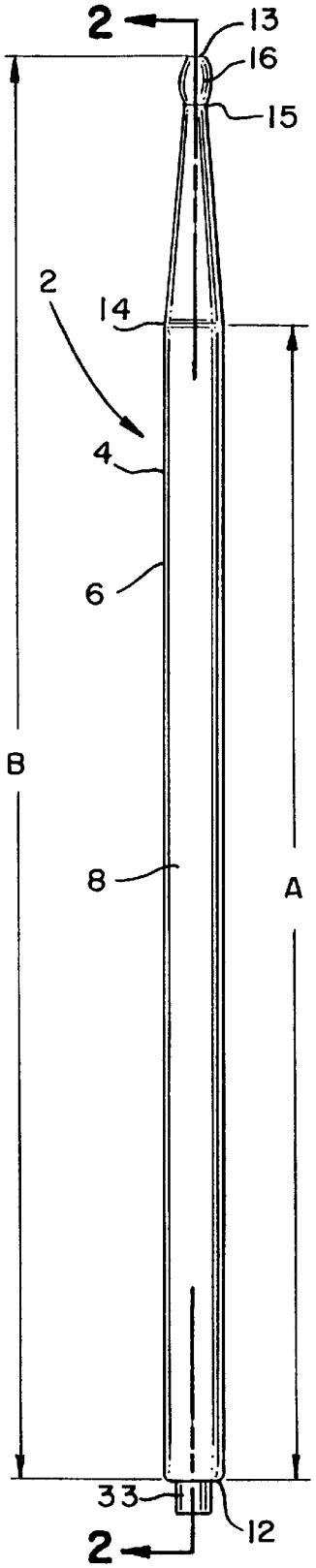
FIG. 1 is a plan elevational view of a drumstick incorporating an adjustable weight system for selectively positioning the center of gravity or balance point of the drumstick.
Figure 2:
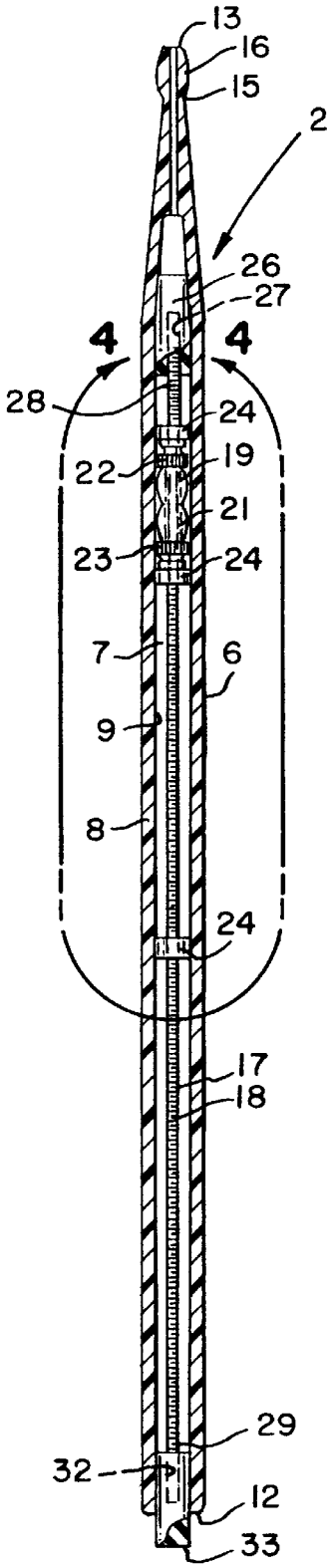
FIG. 2 is a cross-sectional view of the drumstick, the view being taken through the longitudinal axis of the drumstick. Portions of the assembly are shown in elevation for clarity.
Figure 8:
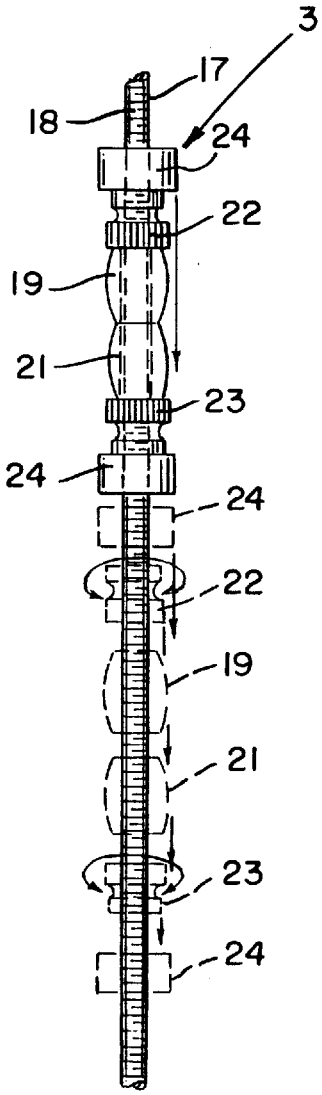
FIG. 8 is a fragmentary elevational view of the portion of the adjustable weight system indicated by the arrows 8–8 in FIG. 3, shown apart from the drumstick, and illustrating the manner in which the weights and other elements of the assembly may selectively be adjusted to shift the position of the center of gravity.

In terms of greater detail, the adjustable weight system equipped drumstick of the invention is illustrated in FIGS. 1 and 2 and designated generally by the numeral 2. The adjustable weight system per se, apart from the drumstick, is shown in FIGS. 3, 4 and 8 and designated generally by the numeral 3.

Referring to the drumstick assembly illustrated in FIGS. 1 and 2, it will be seen that the drumstick 4 is generally tubular in its configuration, having an outer peripheral cylindrical surface 6 of uniform outside diameter of approximately 17/32" over a major portion A of its length, a smooth and uniform inside diameter of approximately 5/16" that defines an elongated cylindrical cavity 7 within the "stick" corresponding in length to the major portion A, the resulting tubular wall 8 having a wall thickness of approximately 7/64" defined by an inner peripheral surface 9, the "stick" having an overall length B of approximately 15⅞" from its butt end 12 to its tip end 13. The drumstick is preferably molded from a polymer-type synthetic resinous material that may be a single material or a "composite" of several synthetic resinous materials mixed with other materials such as wood powder or glass fiber or glass particles.

From a location 14 spaced about 3¼" from the distal or "tip" end of the drumstick, the outer periphery of the drumstick is tapered over a length of about 2¾" to a diameter of about 3/16" at the neck 15, from whence the drumstick tin end is enlarged to provide a bulbous tip 16 of selected style and having a diameter of about 5/16". It should be understood that the dimensions cited are for illustration purposes only, and that other dimensions may be selected to provide a customized drumstick. Because these drumsticks are fabricated from man-made materials and by high technology equipment, it will be understood that extremely high manufacturing tolerances may me maintained. For instance, drumsticks manufactured as illustrated are guaranteed to be within 0.005" in straightness and within 1/10 of an ounce in weight. It should be noted, however, that if it were attempted to fabricate a drumstick from wood having the dimensions indicated, particularly the hollow tube-like characteristic, such wood drumstick would not possess sufficient strength to withstand the impact shocks received by a drumstick when, for instance, it is used to strike the metal rim of a drum, instead of the drum head, for achieving a specific sound affect.

Figure 3:
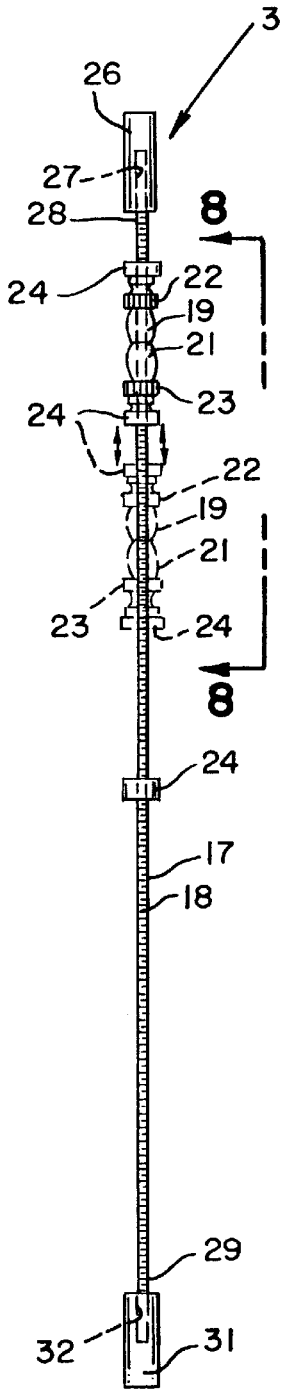
FIG. 3 is an elevational view of the adjustable weight system shown apart from the drumstick.
Figure 4:
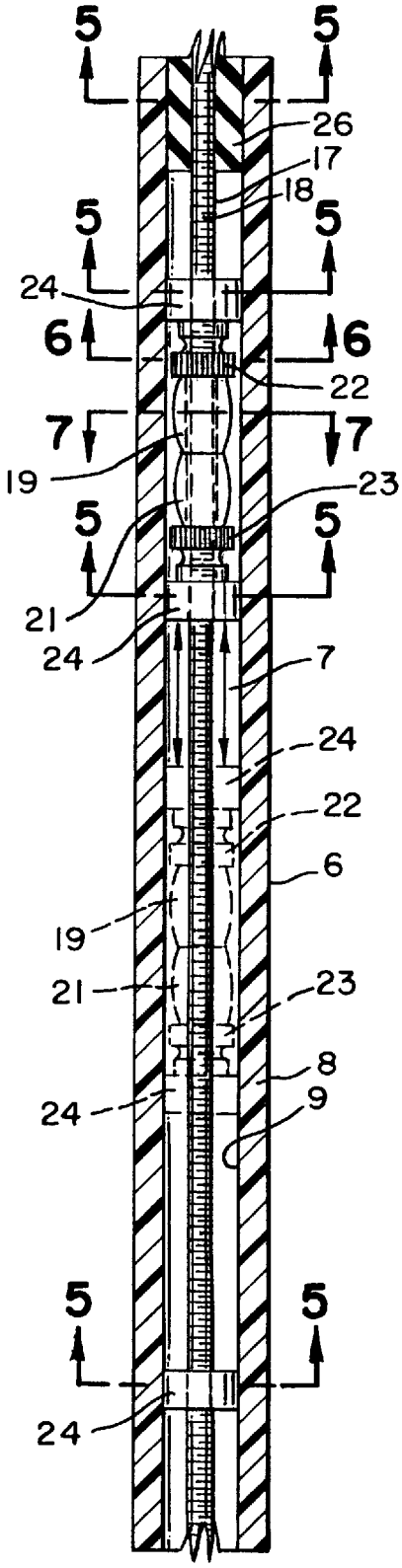
FIG. 4 is an enlarged fragmentary cross-sectional view of the portion of the drumstick enclosed by the line 4—4 in FIG. 2.
Figure 5:
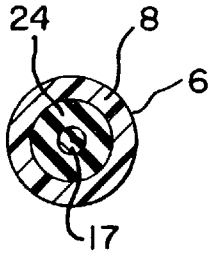
FIG. 5 is a vertical cross-sectional view taken in the plane indicated by the lines 5—5 in FIG. 4, and illustrating the similarity of the structure at various points along the drumstick.
Figure 6:
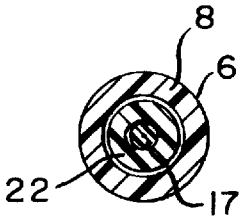
FIG. 6 is a vertical cross-sectional view taken in the plane indicated by the line 6–6 in FIG. 4.
Figure 7:
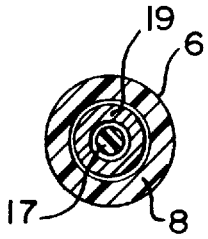
FIG. 7 is a vertical cross-sectional view taken in the plane indicated by the line 7–7 in FIG. 4.

Referring now to FIGS. 3–8, it will be seen that FIG. 3 illustrates the adjustable weight system 3 in its entirety, shown apart from or removed from the tubular drumstick within which it is ultimately mounted as illustrated in FIG. 2. The adjustable weight system or multi-part assembly illustrated in FIG. 3, and in enlarged illustration in FIGS. 4–8, is itself an article of manufacture and includes a central rod-like member or spindle 17, which in this instance comprises an elongated "Nylon" rod having exterior threads 18 formed thereon. Other materials may of course be used. In the embodiment of the invention here illustrated, the center rod or spindle is 3/32" in diameter and approximately 12" long and threaded for its entire length. It should of course be understood that in other embodiments within the spirit of this invention, the center rod may be devoid of threads and the function they perform may be performed by other structure.

Slidably mounted on the center rod or threaded spindle 17 are a pair of weights monolithic 19 and 21, each having an axially directed bore 22 of sufficient diameter to provide a sliding fit on the spindle. Additionally, each of the weights has an outer diameter that provides a sliding fit with the inner periphery 9 of the cavity in the drumstick 4. The weights may be fabricated from many different materials, but it has been found that lead weights of the type used by fishermen are convenient, inexpensive and may easily be formed to provide precise inner and outer diameters and length so as to achieve a near ideal weight of 1/10 of an ounce for each weight. Where lead weights are selected, it is recommended that they be nickel-plated to render them an environmentally safe product.

As shown, the two weights 19 and 21 are abutted end-to-end, and are retained in a selected position along the central rod or spindle 17 by internally threaded "Nylon" nuts 22 and 23 each of which threadably engages the threaded spindle, and since one each of the nuts is positioned at opposite ends of the axially aligned weight assembly 19/21, it will be understood that the nuts prevent inadvertent axial displacement of the two weights while enabling shifting their position as indicated by the broken lines in FIG. 8. All that is required is that the nut associated with the direction in which the shift is to occur be rotated to displace it to its new position, the weights slid into abutting relationship with the new position of the nut, and the other nut rotated to bring it into abutting relationship with the opposite end of the weight assembly. The weight assembly is now again locked in its new position by the two nuts 22 and 23.

Because the inner peripheral bore of each weights fits snugly yet slidably about the spindle, inertia of the weight when the drumstick is used to beat on a drum head does not result in lateral movement of the weight in realtion to the spindle. The same is generally true of the relationship of the outer periphery of each of the weights with the inner periphery of the drumstick. There is little or no tendency for lateral movement of the weight to impact against the inner periphery of the drumstick. However, to insure that this does not occur, cylindrical "silencer" members in the form of annular elastically compressible shock absorber rings 24, each having a central aperture at least halt the diameter of the spindle 17, are pushed onto the spindle so that one each is positioned adjacent the nuts that lock the weights in position. These absorber rings impinge resiliently against the inner periphery 9 of the cavity 7, retain the spindle in concentricity with the inner periphery and axially in coincidence with the longitudinal axis of the drumstick and counteract any tendency of the weights to impinge on the inner periphery of the cavity, thus eliminating any possibility of the generation of extraneous noise from such impact.

The force of inertia is also present in relation to the length of spindle that extends between the butt end 12 of the drumstick and the location of the weights within the drumstick. To support the spindle over this length, and to insure that it remains axially aligned with the longitudinal axis of the drumstick, one (or more) of the ring absorbers 24 is pushed onto the spindle so that it splits the distance between the butt end 12 and the proximal end of the weight assembly, including the nut that holds it in position. Thus, any tendency of this section of the spindle to whip transversely or laterally when the drumstick is used and inertia is generated in the spindle is prevented by the snug fit of the ring absorber concentrically about the spindle and its resilient impingement against the inner periphery 9 of the cavity 7. When it is deemed necessary, more than one such ring absorber may of course be used. However, because of the relatively low weight factor of the spindle, experience has indicated that one such ring absorber positioned medianly along the spindle as described above is sufficient.

For the same reason that the weight assembly and the spindle must be supported against lateral movement as a result of the force of inertia, so too must the ends of the spindle be supported. To support the distal or tip end of the spindle against lateral movement, there is provided in the distal end portion of the cavity, where the drumstick tapers to the neck 15, an elongated cylindrical cushion 26 that fits snugly compressed into the reduced diameter tapered portion of the cavity. The cylindrical cushion 26 is preferably provided with a small bore 27 in its proximal end of sufficient diameter to enable the distal end 28 of the spindle to be inserted into the bore prior to insertion of the assembly into the drumstick cavity. This arrangement is illustrated in FIG. 3.

Preferably, the frictional attachment of the cylindrical cushion 26 to the distal end of the spindle is stronger than the frictional force existing between the cylindrical cushion 26 and the smooth inner periphery of the cavity against which it is compressed. Given these parameters, when the completed assembly as illustrated in FIG. 3 is withdrawn from a drumstick within which it is mounted, the frictional resistance existing between the spindle and the cushion will effect withdrawal of the cushion with the remainder of the assembly. This fact will be readily apparent upon withdrawal of the weight system from the drumstick. In the event the cushion is not withdrawn, all that is required is that when the weight system, or another like it, is re-inserted, the cylindrical cushion be removed from the system being reinserted so that the distal end of the spindle may penetrate the cushion that has remained in place within the drumstick. Alternatively, of course, the retained cushion 26 may be removed from within the drumstick by penetrating a small wire through the tip end of the drumstick and pushing the cushion loose from its position within the cavity.

As with the distal end 28 of the spindle, the proximal end 29 of the spindle that lies within the cavity at the butt end of the drumstick must also be supported so that there is no tendency for it to move laterally with respect to the longitudinal axis of the drumstick when the drumstick is used to beat a drum. To accomplish this, a resiliently compressible cylindrical cushion 31 similar to the cushion 26 and having an axial bore 32 penetrating for about half the length of the cushion, is pressed resiliently onto the proximal end of the spindle as illustrated in FIGS. 2 and 3.

This completed sub-assembly constituting the adjustable weight system may then be inserted into the elongated cavity 7 through the opening into the cavity formed in the butt end 12 of the drumstick. When fully inserted, the cylindrical cushion 31 is press-fitted into the opening into the cavity so that about half its length protrudes from the butt or proximal end of the drumstick in a portion 33 that may be digitally grasped to withdraw the adjustable weight system from the drumstick when that becomes necessary or desirable.

To install the completed adjustable weight assembly illustrated in FIG. 3 into the drumstick, all that is required is that the manufactured and assembled adjustable weight system be withdrawn from its package, and the weighted-end of the assembly inserted into the open end of the cavity in the drumstick. As the assembly penetrates into the cavity, each of the ring absorbers 24 are pressed resiliently into the open end of the cavity. The frictional resistance between the ring absorbers and the spindle is greater than the frictional resistance between the outer periphery of the ring absorbers and the inner periphery of the cavity and as a consequence the ring absorbers retain their position on the spindle and are pushed into the cavity in their initially set position. When the assembly is fully inserted, the cylindrical cushion 31 is press-fitted into the open end of the cavity sufficiently to leave about half its length protruding from the butt end of the drumstick. Assembly is now complete, and the drumstick is ready for use.

To effect adjustment of the adjustable weight system following installation and use of the drumstick, all that is required is that the drumstick be held firmly in one hand and with the index finger and thumb of the other hand grasp the protruding portion 33 of the cushion 31 and gently rock the cushion while imposing a pulling motion. The cushion 31, being attached to the proximal end portion 29 of the spindle, will effectively withdraw the complete adjustable weight system from the cavity within the drumstick. Once free of the cavity, and assuming that the damper cushion 26 has also been withdrawn, which it the preferably case, to add or subtract weights, remove the damper cushion 26 and the associated ring absorber 24 and the associated "Nylon" nut 22. An additional weight, or different weights, may then be slipped onto the spindle. The nut is then re-applied, followed by the ring absorber 24, and finally the damper cushion 26.

The complete assembly may now be re-inserted into the drumstick as previously explained.

To merely adjust the position of the existing weights on the spindle, all that is required is that the assembly be withdrawn from the cavity of the drumstick and that the retention nuts and the intervening weights be re-positioned on the spindle to reflect the desired balance point. The adjusted assembly is then reinserted into the cavity of the drumstick as previously explained.

Having thus described the invention, what is believed to be novel and sought to be protected by letters patent of the United States is as follows.

I claim:

1. In combination, a drumstick comprising an elongated tubular member formed from synthetic resinous material and including inner and outer peripheries symmetrical about a longitudinal axis and having a natural balance point intermediate the opposite ends of said drumstick; and an adjustable weight system detachably enclosed within said inner periphery between said opposite ends and including at least one monolithic body selectively movable axially along said longitudinal axis to a selected location to adjust the position along said drumstick of said balance point.

2. The combination according to claim 1, wherein said drumstick is formed from a polymer-type synthetic resinous material.

3. The combination according to claim 1, wherein said inner and outer peripheries extend over a major portion of the overall length of said drumstick.

4. The combination according to claim 1, wherein said inner and outer peripheries are cylindrically symmetrical about said longitudinal axis over a major portion of the overall length of said drumstick.

5. the combination according to claim 1, wherein said inner and outer peripheries converge toward the distal end of said drumstick for a length of approximately 20% of the overall length of the drumstick.

6. The combination according to claim 1, wherein said adjustable weight system includes an elongated central support rod having a longitudinal axis coincident with the longitudinal axis of said inner periphery of said drumstick, and said at least one monolithic body is adjustably mounted for selective axial translation on said elongated central support rod to control the position of the balance point of said drumstick.

7. The combination according to claim 6, wherein means are provided interposed between said central support rod and the inner periphery of said drumstick to preclude transverse displacement of said adjustable weight system in relation to the longitudinal axis of the drumstick.

8. The combination according to claim 6, wherein means are provided on said central support rod selectively adjustable to impinge on said at least one monolithic body to preclude inadvertent axial displacement of said body while enabling selective axial displacement thereof along said central support rod.

9. The combination according to claim 7, wherein said means interposed between said central support rod and the inner periphery of said drumstick to preclude transverse displacement of said adjustable control system comprises a plurality of ring absorbers spaced along the length of the central support rod.

10. The combination according to claim 6, wherein a resilient damper is interposed between the distal end portion of said central support rod and the inner periphery of said drumstick adjacent the distal end thereof.

11. The combination according to claim 6, wherein a resilient damper is interposed between the proximal end portion of said central support rod and the inner periphery of said drumstick adjacent the proximal end thereof.

12. In combination, a drumstick comprising:

a) an elongated tubular member formed from syntnetic resinous material and including cylindrical inner and outer peripheries symmetrical about a longitudinal axis, said cylindrical inner and outer peripheries extending over a major portion of the overall length of said drumstick, said drumstick having a natural balance point intermediate the opposite ends thereof, said inner and outer peripheries for a minor portion of the length of the drumstick converging toward the distal end of said drumstick; and b) an adjustable weight system including an elongated central support rod having a longitudinal axis coincident with the longitudinal axis of said inner and outer peripheries of said drumstick, at least one monolithic body adjustably mounted on said central support rod for selective axial translation therealong to control the position of the balance point of said drumstick, means mounted on said central support rod in cooperative association with said at least one monolithic body and selectively adjustable to impinge on said at least one monolithic body to preclude inadvertent axial displacement of said body while enabling selective axial displacement thereof along said central support rod, a plurality of elastically resilient ring absorbers interposed between said central support rod and the inner periphery of said drumstick to preclude transverse displacement of said adjustable control system and said central support rod, and elastically resilient damper members interposed between the proximal and distal ends of said central support rod and the associated inner periphery of said drumstick to retain the proximal and distal end portions of said central support rod axially aligned with said longitudinal axis of said drumstick.

13. The combination according to claim 12, wherein said central support rod comprises a cylindrical Nylon rod threaded over a major portion of its length to enable minute adjustment of the position of said at least one monolithic body along the threaded central support rod.

14. The combination according to claim 13, wherein said means impinging on said at least one monolithic body to retain it against inadvertent axial translation on said threaded central support rod comprise Nylon nuts threadably mounted on said threaded central support rod, each nut being threadably translatable fin a selected direction along said central support rod to effect corresponding translation of said at least one monolithic body therealong.

15. As an article of manufacture, an adjustable weight system for elongated tubular drumsticks having inner and outer peripheries symmetrical about a longitudinal axis, comprising:

a) an elongated central support rod;

b) at least one monolithic body having opposite ends and adjustably mounted on said central support rod for selective axial translation therealong;

c) means adjustably mounted on said central support rod and selectively movable therealong to impinge opposite ends of said at least one monolithic body to preclude inadvertent axial translation of said at least one monolithic body while enabling selective axial translation thereof along said central support rod; and d) a plurality of elastically resilient absorber means mounted on said central support rod spaced along the length thereof and adapted to engage the inner periphery of said tubular drumstick when said adjustable weight system is inserted therein.

16. The article of manufacture according to claim 15, wherein said central support rod is formed of a cylindrical Nylon rod threaded over a major portion of its length.

17. The article of manufacture according to claim 13, wherein said plurality of elastically resilient absorber means includes a plurality of cylindrically annular ring absorbers spaced along the central support rod intermediate its ends.

18. The article of manufacture according to claim 15, wherein said plurality of elastically resilient absorber means includes a pair of cylindrical cushion members, one each of which is mounted on the proximal and distal end portions of said central support rod.

* * * * *